US011001404B2

(12) United States Patent
Denner et al.

(10) Patent No.: US 11,001,404 B2
(45) Date of Patent: May 11, 2021

(54) RECTANGULAR CONTAINER HAVING A STIFFENING GROOVE

(71) Applicant: GRAHAM PACKAGING COMPANY, L.P., Lancaster, PA (US)

(72) Inventors: John E. Denner, York, PA (US); Gregory A. Trude, Seven Valleys, PA (US); Paul V. Kelley, Wrightsville, PA (US); Richard K. Ogg, Littlestown, PA (US); Seungyeol Hong, Plainfield, IL (US); David Melrose, Mount Eden (NZ)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 500 days.

(21) Appl. No.: 15/882,567

(22) Filed: Jan. 29, 2018

(65) Prior Publication Data

US 2018/0215494 A1 Aug. 2, 2018

Related U.S. Application Data

(60) Division of application No. 11/476,001, filed on Jun. 28, 2006, now Pat. No. 9,896,233, which is a continuation-in-part of application No. 11/298,473, filed on Dec. 12, 2005, now Pat. No. 7,882,971, which is a continuation-in-part of application No. 10/727,042, filed on Dec. 4, 2003, now Pat. No. 6,974,047, said application No. 11/476,001 is a continuation-in-part of application No. 29/258,955, filed on May 1, 2006, now Pat. No. Des. 533,782, which is a continuation of application No. 29/196,816, filed on Jan. 7, 2004, now Pat. No. Des.

(Continued)

(51) Int. Cl.
*B65D 1/42* (2006.01)
*B65D 1/02* (2006.01)

(52) U.S. Cl.
CPC ..... *B65D 1/0223* (2013.01); *B65D 1/42* (2013.01)

(58) Field of Classification Search
CPC ..... B65D 1/42; B65D 1/0223
USPC ..... 215/375, 381
See application file for complete search history.

(56) References Cited

U.S. PATENT DOCUMENTS

D136,997 S 1/1944 Clark
3,367,380 A 2/1968 Dickey
(Continued)

FOREIGN PATENT DOCUMENTS

WO WO 97/34808 9/1997
WO WO 00/50309 8/2000

OTHER PUBLICATIONS

U.S. Appl. No. 10/727,042 (U.S. Pat. No. 6,974,047), filed Dec. 4, 2003 (Dec. 13, 2005).

(Continued)

*Primary Examiner* — Sue V Weaver
(74) *Attorney, Agent, or Firm* — Stradley Ronon Stevens and Young, LLP

(57) ABSTRACT

A blow molded plastic container is provided. The container has a body section having a substantially non-circular cross-sectional shape, the body section having an enclosed bottom portion that forms a bottom end of the container and substantially flat side portions extending upwardly from the bottom end; a finish defining an opening; and a dome extending from the body section to the finish. The dome includes at least one stiffening structure formed by an inwardly indented, vertically extending groove.

20 Claims, 6 Drawing Sheets

Related U.S. Application Data

525,527, said application No. 11/476,001 is a continuation-in-part of application No. 29/258,966, filed on May 1, 2006, now Pat. No. Des. 533,786, and a continuation-in-part of application No. 29/258,967, filed on May 1, 2006, now Pat. No. Des. 536,258, which is a continuation of application No. 11/298,473, filed on Dec. 12, 2005, now Pat. No. 7,882,971, said application No. 29/258,966 is a continuation of application No. 11/298,473, filed on Dec. 12, 2005, now Pat. No. 7,882,971.

(60) Provisional application No. 60/430,944, filed on Dec. 5, 2002.

(56) References Cited

U.S. PATENT DOCUMENTS

| | | | |
|---|---|---|---|
| 3,536,500 | A | 10/1970 | Cleereman et al. |
| 3,537,498 | A | 11/1970 | Amand |
| 4,308,955 | A | 1/1982 | Schieser et al. |
| 4,372,455 | A | 2/1983 | Cochran |
| D294,117 | S | 2/1988 | Rogler et al. |
| 4,863,046 | A | 9/1989 | Collette et al. |
| 4,877,141 | A | 10/1989 | Hayashi et al. |
| D316,967 | S | 5/1991 | York |
| D316,968 | S | 5/1991 | York |
| 5,092,474 | A | 3/1992 | Leigner |
| 5,158,817 | A | 10/1992 | Krishnakumar |
| D331,017 | S | 11/1992 | Chan |
| 5,165,557 | A | 11/1992 | Ota et al. |
| 5,178,290 | A | 1/1993 | Ota et al. |
| 5,199,588 | A | 4/1993 | Hayashi |
| 5,222,615 | A | 6/1993 | Ota et al. |
| 5,224,614 | A | 7/1993 | Bono et al. |
| 5,238,129 | A | 8/1993 | Ota |
| D340,190 | S | 10/1993 | Skidmore et al. |
| D347,391 | S | 5/1994 | Guertin |
| 5,337,909 | A | 8/1994 | Vailliencourt |
| 5,337,924 | A | 8/1994 | Dickie |
| 5,350,078 | A | 9/1994 | Potts et al. |
| 5,392,937 | A | 2/1995 | Prevot et al. |
| 5,472,105 | A | 12/1995 | Krishnakumar et al. |
| D378,274 | S | 3/1997 | Beaver |
| D378,353 | S | 3/1997 | Emre et al. |
| 5,758,790 | A | 6/1998 | Ewing, Jr. |
| 5,762,221 | A | 6/1998 | Tobias et al. |
| 5,803,289 | A | 9/1998 | Brady |
| 5,848,516 | A | 12/1998 | Ban |
| 5,908,127 | A | 6/1999 | Weick et al. |
| D420,919 | S | 2/2000 | Ogg |
| 6,036,037 | A | 3/2000 | Scheffer et al. |
| 6,044,997 | A | 4/2000 | Ogg |
| D427,077 | S | 6/2000 | Heliste et al. |
| 6,076,688 | A | 6/2000 | Forget |
| 6,223,920 | B1 | 5/2001 | Lane et al. |
| D445,695 | S | 7/2001 | Ogg |
| 6,257,433 | B1 | 7/2001 | Ogg et al. |
| D446,458 | S | 8/2001 | Gans |
| 6,273,282 | B1 | 8/2001 | Ogg et al. |
| 6,277,321 | B1 | 8/2001 | Vailliencourt et al. |
| D447,411 | S | 9/2001 | Lichtman et al. |
| D451,032 | S | 11/2001 | Iizuka et al. |
| D451,033 | S | 11/2001 | Iizuka et al. |
| D452,444 | S | 12/2001 | Iizuka et al. |
| 6,347,717 | B1 | 2/2002 | Eberle |
| D459,234 | S | 6/2002 | Bourque et al. |
| D465,158 | S | 11/2002 | Peek et al. |
| 6,575,321 | B2 | 6/2003 | Bourque et al. |
| D486,739 | S | 2/2004 | Taylor et al. |
| D488,722 | S | 4/2004 | Evans et al. |
| 6,739,467 | B2 | 5/2004 | Saito et al. |
| D498,143 | S | 11/2004 | Rashid |
| 6,830,158 | B2 | 12/2004 | Yourist |
| D504,617 | S | 5/2005 | Pedmo et al. |
| D507,746 | S | 7/2005 | Sasaki et al. |
| 6,974,047 | B2 | 12/2005 | Kelley et al. |
| 7,017,763 | B2 | 3/2006 | Kelley |
| D525,528 | S | 7/2006 | Lane et al. |
| D528,437 | S | 9/2006 | Durkee |
| D533,782 | S | 12/2006 | Ogg et al. |
| 7,165,693 | B2 | 1/2007 | Oguchi et al. |
| 7,455,189 | B2 | 11/2008 | Lane et al. |
| 2001/0030167 | A1 | 10/2001 | Mooney |
| 2003/0136754 | A1 | 7/2003 | Bourque et al. |
| 2004/0011785 | A1 | 1/2004 | Van Der Heijden et al. |
| 2004/0256399 | A1 | 12/2004 | Tanaka et al. |
| 2005/0035084 | A1 | 2/2005 | Simpson, Jr. et al. |
| 2005/0045645 | A1 | 3/2005 | Tsutsui et al. |
| 2006/0054587 | A1 | 3/2006 | Oguchi et al. |
| 2007/0187354 | A1 | 8/2007 | Sasaki |
| 2007/0210028 | A1 | 9/2007 | Heisner et al. |

OTHER PUBLICATIONS

U.S. Appl. No. 11/298,473 (U.S. Pat. No. 7,882,971), filed Dec. 12, 2005 (Feb. 8, 2011).
U.S. Appl. No. 11/476,001 (U.S. Pat. No. 9,896,233), filed Jun. 28, 2006 (Feb. 20, 2018).
U.S. Appl. No. 29/196,816 (U.S. Pat. No. Des. 525,527), filed Jan. 7, 2004 (Jul. 25, 2006).
U.S. Appl. No. 29/258,955 (U.S. Pat. No. Des. 533,782), filed May 1, 2006 (Dec. 19, 2006).
U.S. Appl. No. 29/258,966 (U.S. Pat. No. Des. 533,786), filed May 1, 2006 (Dec. 19, 2006).
U.S. Appl. No. 29/258,967 (U.S. Pat. No. Des. 536,258), filed May 1, 2006 (Feb. 6, 2007).
U.S. Appl. No. 10/727,042, Oct. 17, 2005 Issue Fee Payment.
U.S. Appl. No. 10/727,042, Sep. 14, 2005 Notice of Allowance.
U.S. Appl. No. 10/727,042, Jun. 28, 2005 Response to Non-Final Office Action.
U.S. Appl. No. 10/727,042, Oct. 25, 2005 Non-Final Office Action.
U.S. Appl. No. 11/298,473, Jan. 3, 2011 Issue Fee Payment.
U.S. Appl. No. 11/298,473, Oct. 6, 2010 Notice of Allowance.
U.S. Appl. No. 11/298,473, Jul. 23, 2010 Response after Final Action.
U.S. Appl. No. 11/298,473, Jul. 1, 2010 Final Office Action.
U.S. Appl. No. 11/298,473, Apr. 13, 2010 Response to Non-Final Office Action.
U.S. Appl. No. 11/298,473, Mar. 29, 2010 Non-Final Office Action.
U.S. Appl. No. 11/298,473, Jan. 13, 2010 Response to Non-Final Office Action.
U.S. Appl. No. 11/298,473, Dec. 7, 2009 Non-Final Office Action.
U.S. Appl. No. 11/298,473, Oct. 21, 2009 Response to Non-Final Office Action.
U.S. Appl. No. 11/298,473, Sep. 8, 2009 Non-Final Office Action.
U.S. Appl. No. 11/298,473, Jun. 26, 2009 Response to Restriction Requirement.
U.S. Appl. No. 11/298,473, May 28, 2009 Restriction Requirement.
U.S. Appl. No. 11/476,001, Jan. 10, 2018 Issue Fee Payment.
U.S. Appl. No. 11/476,001, Oct. 10, 2017 Notice of Allowance.
U.S. Appl. No. 11/476,001, Sep. 22, 2015 Reply Brief Filed.
U.S. Appl. No. 11/476,001, Jul. 22, 2015 Examiner's Answer to Appeal Brief.
U.S. Appl. No. 11/476,001, Feb. 20, 2015 Appeal Brief Filed.
U.S. Appl. No. 11/476,001, Dec. 22, 2014 Notice of Appeal Filed.
U.S. Appl. No. 11/476,001, Dec. 4, 2014 Advisory Action.
U.S. Appl. No. 11/476,001, Nov. 24, 2014 Response after Final Action.
U.S. Appl. No. 11/476,001, Sep. 23, 2014 Final Office Action.
U.S. Appl. No. 11/476,001, Jun. 24, 2014 Response to Non-Final Office Action.
U.S. Appl. No. 11/476,001, Mar. 24, 2014 Non-Final Office Action.
U.S. Appl. No. 11/476,001, Feb. 20, 2014 Amendment and Request for Continued Examination (RCE).
U.S. Appl. No. 11/476,001, Aug. 23, 2011 Reply Brief Filed.
U.S. Appl. No. 11/476,001, Mar. 3, 2011 Appeal Brief Filed.
U.S. Appl. No. 11/476,001, Jan. 12, 2011 Advisory Action.

(56) References Cited

OTHER PUBLICATIONS

U.S. Appl. No. 11/476,001, Jan. 6, 2011 Notice of Appeal Filed.
U.S. Appl. No. 11/476,001, Jan. 5, 2011 Response after Final Action.
U.S. Appl. No. 11/476,001, Dec. 7, 2010 Advisory Action.
U.S. Appl. No. 11/476,001, Nov. 19, 2010 Response after Final Action.
U.S. Appl. No. 11/476,001, Oct. 8, 2010 Final Office Action.
U.S. Appl. No. 11/476,001, Jun. 30, 2010 Response to Non-Final Office Action.
U.S. Appl. No. 11/476,001, Mar. 23, 2010 Response to Non-Final Office Action.
U.S. Appl. No. 11/476,001, Jan. 20, 2010 Non-Final Office Action.
U.S. Appl. No. 11/476,001, Nov. 12, 2009 Response to Restriction Requirement.
U.S. Appl. No. 11/476,001, Oct. 27, 2009 Restriction Requirement.
U.S. Appl. No. 29/196,816, Mar. 27, 2006 Issue Fee Payment.
U.S. Appl. No. 29/196,816, Mar. 8, 2006 Notice of Allowance.
U.S. Appl. No. 29/196,816, Oct. 3, 2006 Issue Fee Payment.
U.S. Appl. No. 29/196,816, Jul. 27, 2006 Notice of Allowance.
U.S. Appl. No. 29/196,816, Oct. 27, 2006 Issue Fee Payment.
U.S. Appl. No. 29/196,816, Dec. 8, 2006 Issue Fee Payment.
U.S. Appl. No. 29/196,816, Sep. 8, 2006 Notice of Allowance.
U.S. Appl. No. 29/196,816 (U.S. Pat. No. D. 525,527), filed Jan. 7, 2004 (Jul. 25, 2006).
U.S. Appl. No. 29/258,955 (U.S. Pat. No. D. 533,782), filed May 1, 2006 (Dec. 19, 2006).
U.S. Appl. No. 19/258,966 (U.S. Pat. No. D. 533,786), filed May 1, 2006 (Dec. 19, 2006).
U.S. Appl. No. 29/258,967 (U.S. Pat. No. D. 536,258), filed May 1, 2006 (Feb. 6, 2007).
U.S. Appl. No. 10/727,042, Oct. 25, 2004 Non-Final Office Action.
U.S. Appl. No. 29/258,955, Oct. 3, 2006 Issue Fee Payment.
U.S. Appl. No. 29/258,955, Jul. 27, 2006 Notice of Allowance.
U.S. Appl. No. 29/258,966, Oct. 27, 2006 Issue Fee Payment.
U.S. Appl. No. 29/258,966, Jul. 27, 2006 Notice of Allowance.
U.S. Appl. No. 29/258,967, Dec. 8, 2006 Issue Fee Payment.
U.S. Appl. No. 29/258,966, Sep. 8, 2006 Notice of Allowance.

RECTANGULAR CONTAINER HAVING A STIFFENING GROOVE

This application is a divisional of U.S. patent application Ser. No. 11/476,001 filed Jun. 28, 2006, now U.S. Pat. No. 9,896,233, which is a continuation-in-part of U.S. patent application Ser. No. 11/298,473, filed Dec. 12, 2005, now U.S. Pat. No. 7,882,971, which is a continuation-in-part of U.S. patent application Ser. No. 10/727,042, filed Dec. 4, 2003, now U.S. Pat. No. 6,974,047, which claims priority to U.S. provisional application No. 60/430,944, filed Dec. 5, 2002. This application is also a continuation-in-part of U.S. Design patent application Ser. No. 29/258,955, filed May 1, 2006, now U.S. Design Pat. No. D553,782, which is a continuation of U.S. Design patent application Ser. No. 29/196,816, filed Jan. 7, 2004 now U.S. Design Pat. No. D525,527. This application is also a continuation-in-part of U.S. Design patent application Ser. No. 29/258,966, filed May 1, 2006, now U.S. Design Pat. No. D533,786, and a continuation-in-part of U.S. Design patent application Ser. No. 29/258,967, filed May 1, 2006, now U.S. Design Pat. No. D536,258, which are continuations of U.S. patent application Ser. No. 11/298,473, now U.S. Pat. No. 7,882,971. Each of these applications is incorporated herein by reference in its entirety.

The invention relates generally to blow molded, non-circular plastic containers.

BACKGROUND OF THE INVENTION

In the manufacture of blow molded plastic containers for containing liquids such as beverages, it is customary to utilize an injection-molded parison having a threaded finish that forms the threaded finish of the container blown from the parison. The parison may be injection molded from a variety of desirable plastic containers, with a currently particularly preferred material being polyethylene terephthalate (PET).

The configuration and overall aesthetic appearance of a blow molded plastic container affects consumer purchasing decisions. For instance, distorted or otherwise unaesthetic appearing containers may provide the basis for some consumers to purchase a different brand of product which is packaged in an aesthetically pleasing manner.

While a container in its as-designed configuration may provide an appealing appearance when it is initially removed from blow molding machinery, many forces act subsequently on, and alter, the as-designed shape from the time it is blow molded to the time it is placed on a shelf in a store. Plastic containers are particularly susceptible to distortion since they are continually being redesigned in an effort to reduce the amount of plastic required to make the container. This particularly persistent problem in the manufacture of plastic containers is known in the industry as "lightweighting." Manufacturers continue to develop new technologies that enable them to reduce the amount of PET resin needed to make a bottle without compromising performance. These efforts are extremely important in reducing manufacturing costs because PET resin accounts for a significant portion of the cost of the finished bottle. While there is a savings, with respect to material cost, the reduction of plastic can decrease container rigidity and structural integrity.

In the packaging of beverages and other products, especially juice, blow molded plastic PET containers are used in "hot fill" applications, i.e., applications where the blown container is filled with a liquid at a temperature in excess of 180° F. (82° C.), capped immediately after filling, and allowed to cool to ambient temperatures. Internal forces act on the container as a result of the hot fill processing, for example, shrinkage resulting from the cooling of the container contents. Hot fill containers must provide sufficient flexure to compensate for the changes of pressure and temperature, while maintaining structural integrity and aesthetic appearance. Vacuum absorption panels are generally provided in the body of the container to accommodate the internal pressure changes. Hot fill containers molded of PET by this technique have found widespread acceptance in the marketplace.

External forces are also applied to sealed containers as they are packed and shipped. Filled containers are packed in bulk in cardboard boxes, or plastic wrap, or both. A bottom row of packed, filled containers may support several upper tiers of filled containers, and potentially, several upper boxes of filled containers. Therefore, it is important that the container have a top loading capability which is sufficient to prevent distortion from the intended container shape. As containers are lightweighted, external forces such as top loading can act on the weakest structural portion to cause distortion or collapse. This can include areas that were previously considered structurally sound. This problem is further complicated in non-circular containers.

Typically, a tubular parison is utilized to make circular or other shaped containers. When a circular container is formed from a tubular parison, orientation and stretch levels around the circumference of the container are relatively uniform. However, when a non-circular container is formed from a tubular parison, stretching problems occur during fabrication. Particularly in the base of the container, unequal stretching may result in unequal and not regularly repeatable shrinkage after the tubular parison is stretched into, for example, a square cross-sectional shape. This problematical shrinkage is particularly undesirable in the bottom section of the container at the seating ring and up to the body section of the container, and results in highly stretched corners and less stretched middle sections and sides. This can result in an unstable or tilted container instead one that sits flat upon a shelf or the like, or having visible deformations. Similar though less extreme problems arise in the dome of the container.

Also, when the container is hot filled and sealed, the subsequent thermal contraction of the container tends to deform the container walls and bottom section. Backflow into the filling mechanism and the use of vacuum filling equipment during filling operations can similarly create a partial vacuum inside the container resulting in its deformation. Such deformation typically concentrates at the mechanically weaker portions of the container, such as the unevenly stretched bottom section, resulting in an exaggerated irregular seating surface and commercially unacceptable appearance. This problem is exacerbated when the container body includes collapse panels, indented surfaces areas which provide for controlled, quantified collapse of the container upon evacuation.

By increasing the thickness of the container, it is possible to some extent to strengthen the container and decrease the effects of vacuum deformation. However, as mentioned above, increasing the thickness of the container results in an increase in the amount of raw materials required to produce the container and a decrease in production speed. The resultant increased costs are not acceptable to the container industry. Additionally, even with increased container thickness, there still is uneven stretching around the bottom section of the non-cylindrical container.

BRIEF SUMMARY OF THE INVENTION

An embodiment of the invention provides a blow molded plastic container having a body section with a substantially non-circular cross-sectional shape, the body section having an enclosed bottom portion that forms a bottom end of the container and substantially flat side portions extending upwardly from the bottom end; a finish defining an opening; and a dome extending from the body section to the finish. The dome includes at least one stiffening structure formed by an inwardly indented, vertically extending groove.

Other embodiments of the invention provide a blow molded plastic container having a body section with a substantially non-circular shape in cross section, the body section having an enclosed bottom portion that forms a bottom end of the container and substantially flat side portions extending upwardly from the bottom end; a finish defining an opening; and a dome extending from the body section to the finish. One of the side portions of the body section includes at least one outwardly protruding, substantially horizontal rib.

Other embodiments of the invention provide a blow-molded plastic container having a body section with a substantially non-circular shape in cross section, the body section having an enclosed bottom portion that forms a bottom end of the container, substantially flat side portions extending upwardly from the bottom end, and a heel portion that transitions from the bottom portion to the side portions, wherein the heel portion includes at least one stiffening groove; a finish defining an opening; and a dome extending from the body section to the finish.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF EMBODIMENTS OF THE INVENTION

Figure 1:
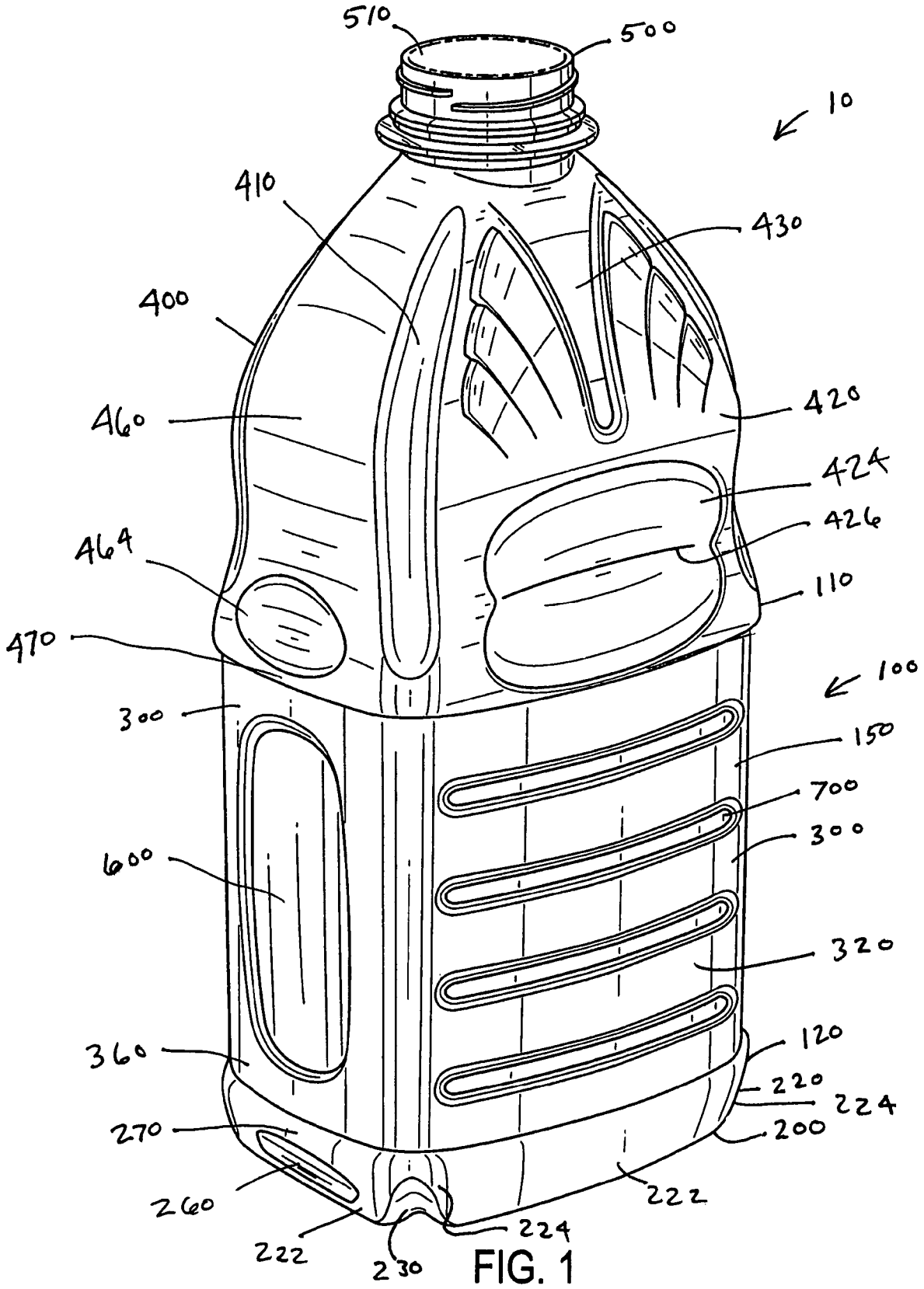
FIG. 1 is a perspective view of an exemplary embodiment of a plastic container according to the invention.
Figure 2:
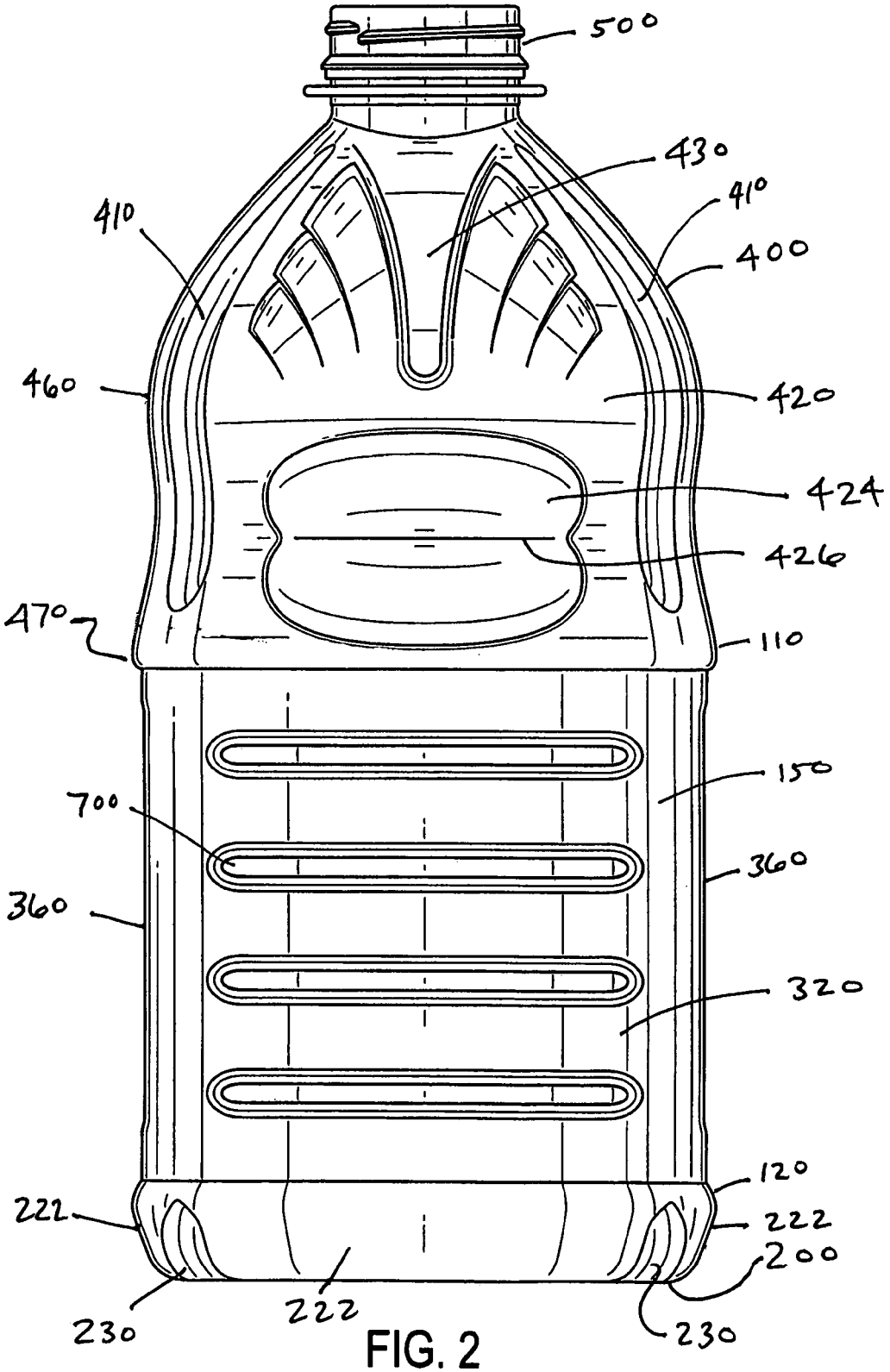
FIG. 2 is a front elevation view of the plastic container of FIG. 1.
Figure 3:
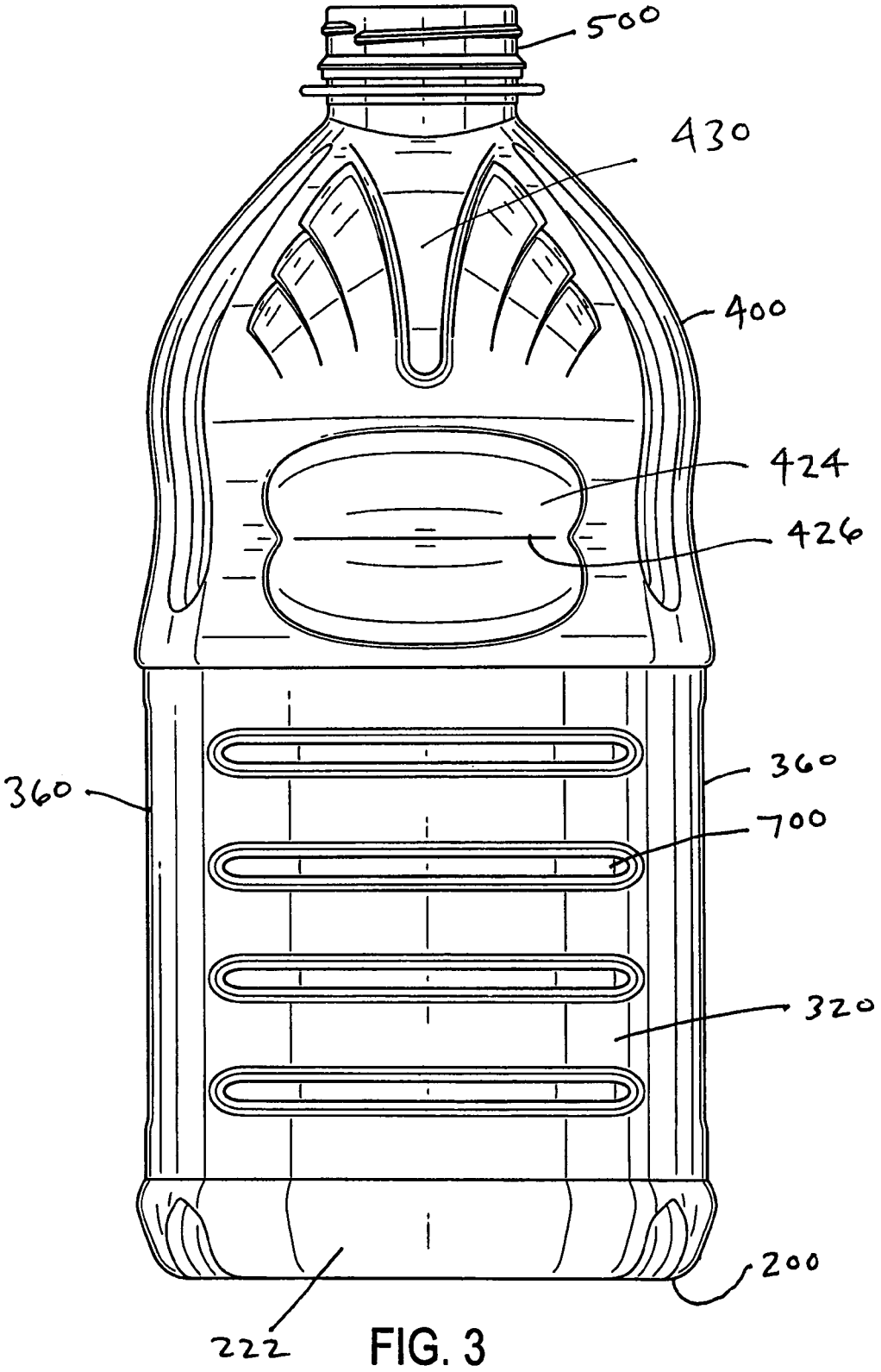
FIG. 3 is a rear elevation view of the plastic container of FIG. 1.
Figure 4:
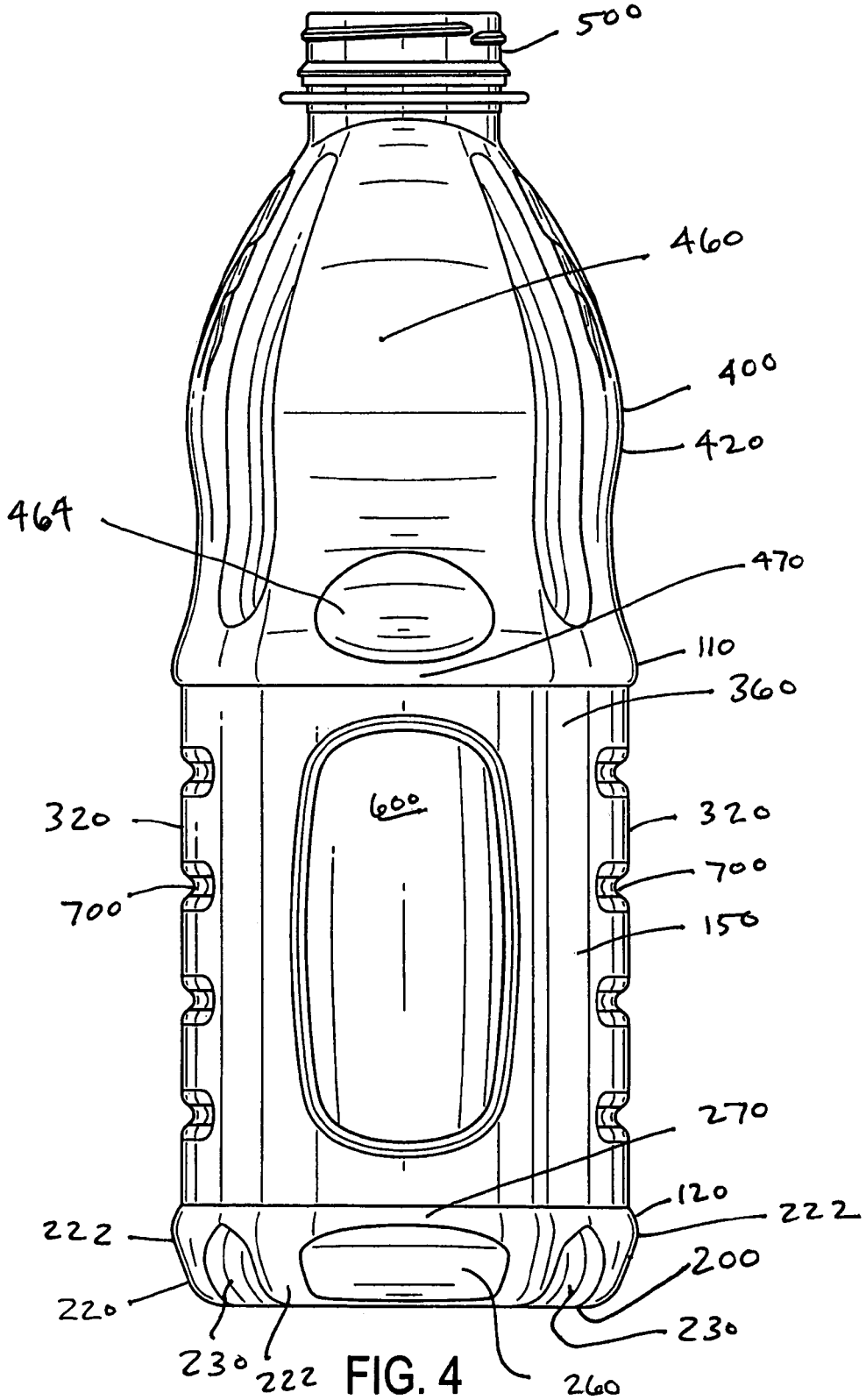
FIG. 4 is a right side elevation view of the plastic container of FIG. 1.
Figure 5:
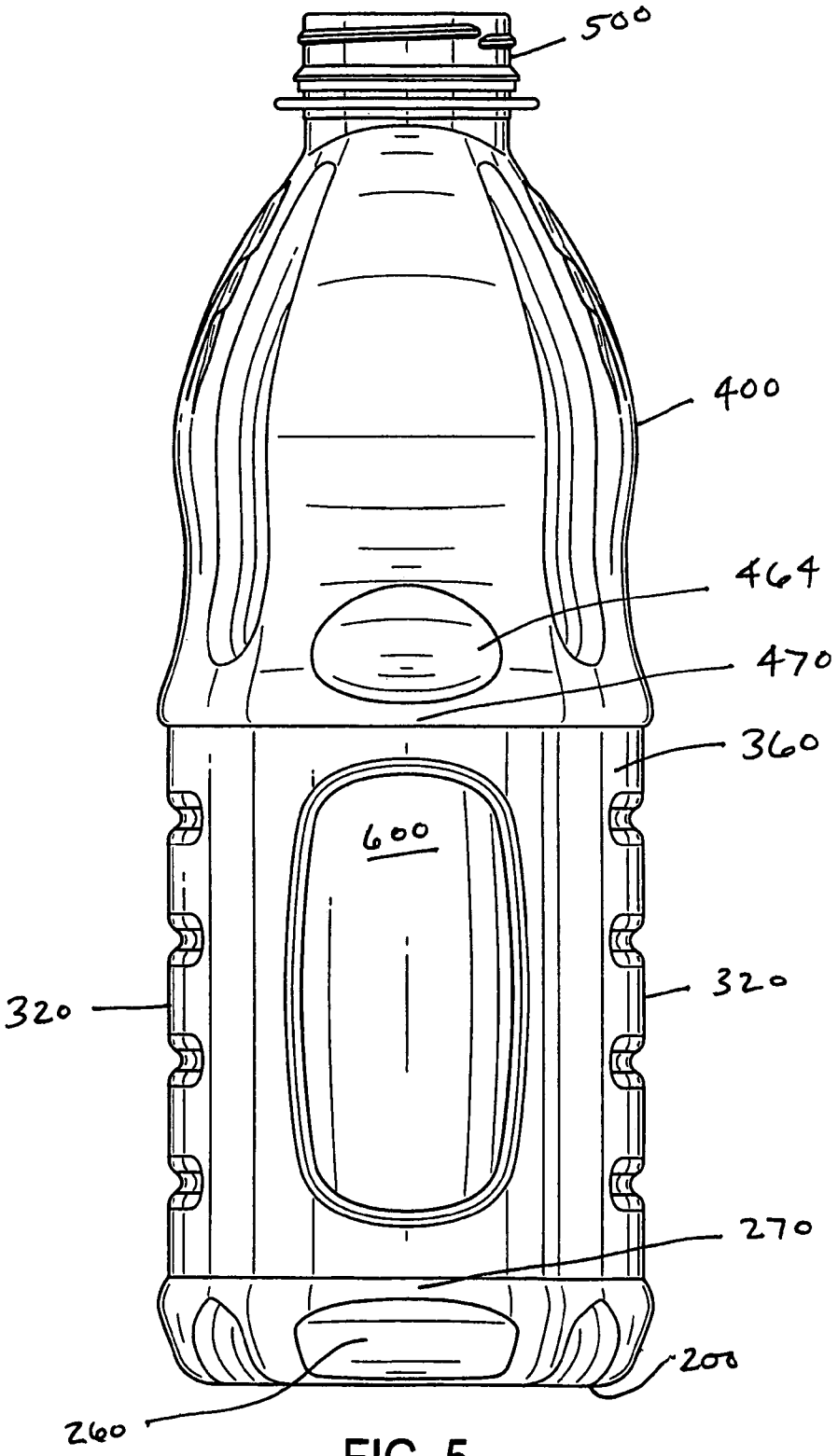
FIG. 5 is a left side elevation view of the plastic container of FIG. 1.

A thin-walled container in accordance with the invention can be filled with a liquid at a temperature above room temperature in so-called hot-fill processing. In a hot fill process, a product is added to the container at an elevated temperature, about 82° C., which can be near the glass transition temperature of the plastic material, and the container is capped. As the container and its contents cool, the contents tend to contract and this volumetric change creates a partial vacuum within the container. In the absence of some means for accommodating these internal volumetric and barometric changes, containers tend to deform and/or collapse. In addition to these changes that adversely affect the appearance of the container, distortion or deformation can cause the container to lean or become unstable. This is particularly true where deformation of the base region occurs. As used herein, hot-fill processing includes conventional hot-fill techniques, as well as pasteurization and retort processing. The container can be filled by automated, high speed, hot-fill equipment known in the art.

Containers according to the invention can have a one-piece construction and be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. Exemplary containers according to the present invention may be formed from a plastic material such as polyethylene terephthlate (PET) or other polyester.

The container can be blow molded by, for example, extrusion blow molding, stretch blow molding or injection blow molding. In extrusion blow molding, a molten tube of thermoplastic material, or plastic parison, is extruded between a pair of open blow mold halves. The blow mold halves close about the parison and cooperate to provide a cavity into which the parison is blown to form the container. As formed, the container can include extra material, or flash, at the region where the molds come together, or extra material, or a moil, intentionally present above the container finish. After the mold halves open, the container drops out and is then sent to a trimmer or cutter where any flash of moil is removed. The finished container may have a visible ridge formed where the two mold halves used to form the container came together. This ridge is often referred to as the parting line.

In stretch blow molding, a preformed parison, or preform, is prepared from a thermoplastic material, typically by an injection molding process. The preform typically includes a threaded end, which becomes the threads of the container. The preform is positioned between two open blow mold halves. The blow mold halves close about the preform and cooperate to provide a cavity into which the preform is blown to form the container. After molding, the mold halves open to release the container. Stretch blow molding is an exemplary method for forming containers according to the invention. Injection blow molding is similar to stretch blow molding. In injection blow molding, a thermoplastic material is extruded through a rod into an inject mold to form a parison. The parison is positioned between two open blow mold halves. The blow mold halves close about the parison and cooperate to provide a cavity into which the parison is blown to form the container. After molding, the mold halves open to release the container.

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Referring to the drawings, a plastic container 10 in accordance with an embodiment of the invention has a body section 100 that has a substantially non-circular cross section. Body section 100 has an enclosed bottom portion 200 that forms a bottom end of container 10 and substantially flat side portions 300 extending upwardly from bottom portion 200. Container 10 further includes a finish 500 that defines an opening 510, and a dome 400 extending from body section 100 to finish 500. Finish 500 may include external threads for a closure (not shown).

Container 10 illustrated in the drawings is an example of a container used to package beverages. More specifically, the illustrated container which will be discussed herein in detail is intended to accommodate 64 ounces of hot-fillable juice. However, container 10 in accordance with the invention can be used to package any number of different types of products and can be manufactured in a large range of sizes, such as, for example, eight ounces to one gallon.

Body section 100 can be defined by four of the side portions 300, with two of the four side portions being face portions 320 and two of the side portions being end portions 360. As a general matter, body section 100 can be of any polygonal shape in cross section, for example, rectangular (as shown in the Figures), square, hexagonal or octagonal.

Generally, body section 100 includes an upper label bumper 110 and a lower label bumper 120. Upper label bumper 110 and lower label bumper 120 define the extent of a label mounting area 150.

In the exemplary embodiment, body section 100 includes at least one indented panel 600 on at least one of the side portions 320, 360. Indented panel 600 can, for example, be a vertically oriented panel, with one indented panel on each of the two end portions 360. In the exemplary embodiment shown, one panel 600 is located on each end portion 360.

Side portions 320, 360 can include one or more horizontally oriented, inwardly indented stiffening rib 700. For example, four stiffening ribs 700 can be provided. In the embodiment shown, four stiffening ribs 700 are provided on each face portion 320. Stiffening ribs 700 and indented panels 600 can be provided in label mounting area 150.

Similar to the body section 100, dome 400 is defined by two oppositely facing dome face portions 420 and two oppositely facing dome end portions 460. Dome 400 can be generally bell-shaped in that the distance between opposing sides can, generally and by way of example, initially decrease as viewed upwardly from the body section 100, then increase, and finally taper to finish 500, as shown in the illustrated embodiment.

Dome 400 can include at least one stiffening structure. In an exemplary embodiment, the stiffening structure is formed by an inwardly indented, vertically extending groove 410, for example, a concave groove 410. The stiffening structure, in this example groove 410, is adapted to control distortion in dome 400 and increase top loading strength. Although the stiffening structure is shown as grooves, channels, ribs, or other equivalent post-like structures can be provided.

Figure 6:
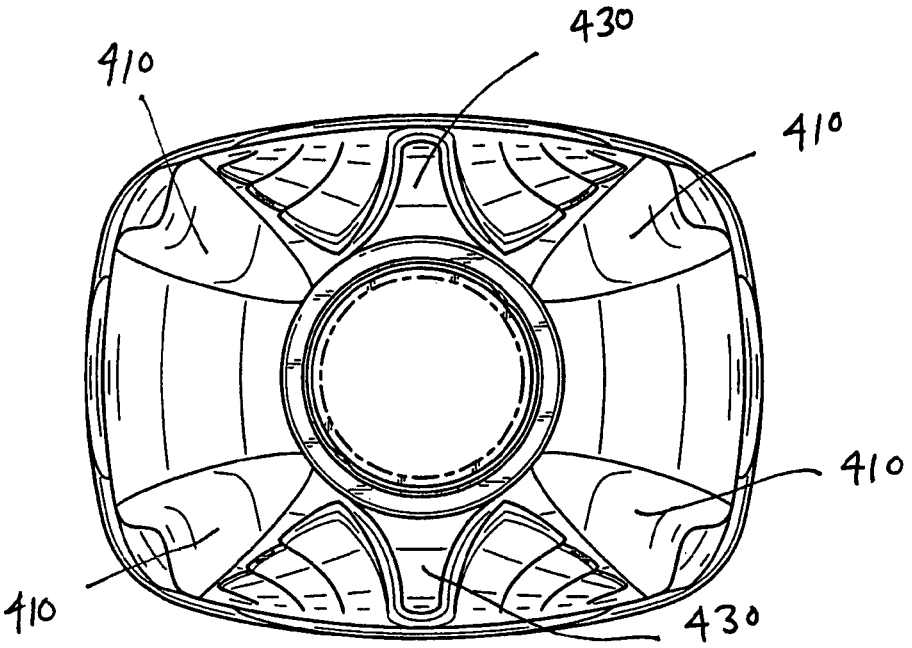
FIG. 6 is a top view of the plastic container of FIG. 1.
Figure 7:
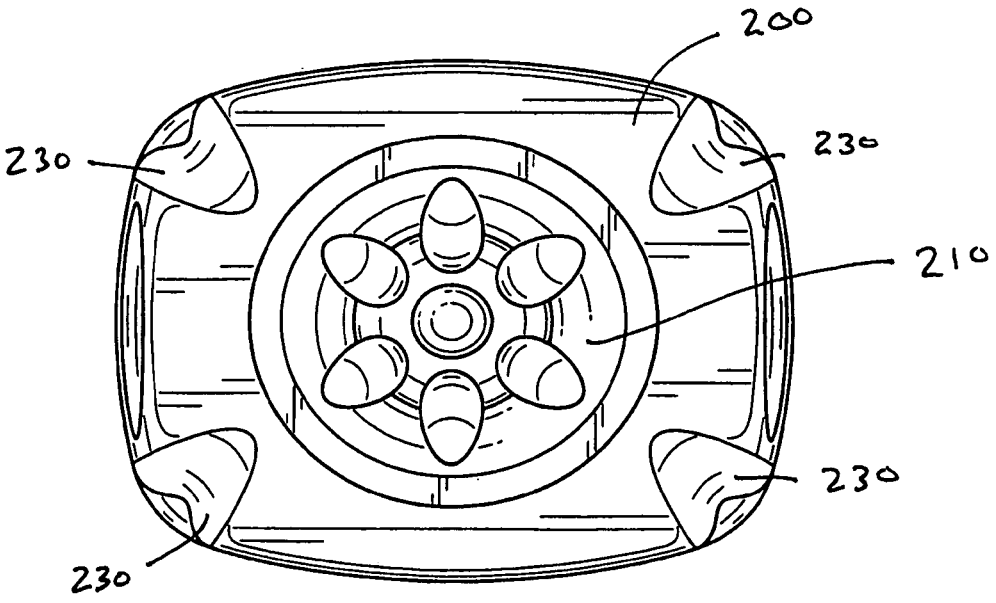
FIG. 7 is a bottom view of the plastic container of FIG. 1.

In the exemplary embodiment shown, dome 400 includes four grooves 410, with one groove 410 on each corner of dome 400. However, any number including two or more grooves or other stiffening structures can be used in accordance with the invention. In FIG. 6, the inwardly indented, vertically extending groove 410 is V-shaped when viewed from the top view orientation of the container. It is contemplated that groove 410 may be V-shaped or W-shaped in cross-section.

As shown, grooves 410 can extend throughout substantially the entire vertical extent of dome 400.

An inward indentation 464 can be provided on each dome end portion 460. An inward indentation 424 can be provided on each dome face portion 420. Inward indentations 424, 464 can function as grips, and can include one or more stiffening ribs 426. Panels 424, 464 can also function to further reinforce and strengthen dome 400.

One or more vacuum panels can be provided. For example, panels 600 or inward indentations 424, 464 can additionally function as vacuum panels to help make container 10 suitable for hot-fill processing.

Dome 400 can include at least one vertically oriented area 430 extending downwardly from finish 500. Area 430 can be indented or raised.

Bottom portion 200 of body section 100 can include a push-up base 210.

Body section 100 can further include a heel portion 220 that transitions from bottom portion 200 to side portions 300 of body section 100. In one embodiment, heel portion 220 includes at least one stiffening groove 230, preferably four stiffening grooves 230. Heel portion 220 can include side heel segments 222 joined together at corners 224, with stiffening grooves 230 being located at corners 224 of heel portion 220. Stiffening grooves 230 can increase the top loading capability of container 10. Stiffening grooves 230 are inwardly indented or convex in an exemplary embodiment. Stiffening grooves 320 can be relatively deep and extend from adjacent push up base 210 to lower label bumper 120.

As mentioned above, blow molding non-circular containers result in unique stretching problems during fabrication, particularly in the base or heel portion 220 of the container and even more particularly at corners 224 of heel portion 220. Uneven stretching during fabrication may result in unstable or tilted containers or containers that have inadequate top loading capability.

By using stiffening grooves 230 at corners 224, the thinnest, and thereby weakest, area of heel portion 220 is effectively eliminated, and replaced with a thicker, geometrically stronger support. Grooves 230 can increase the top loading capacity by, for example, 13% to 20%.

Body section 100 can further include at least one, preferably two, outwardly indented, preferably convex, substantially horizontal ribs 270 that function to increase resistance to bumper contact of other containers, a feature known as "bumper resistance". Generally, bumper resistance is a reduction in contact areas between adjacent bottles during manufacture and processing, which results in less denting, as well as reducing the chances of a bottle knocking over an adjacent bottle. Horizontal ribs 270 reduce the potential contact area between container 10 and an adjacent container on a manufacturing or processing line. Bumper resistance is particularly important in non-circular containers that have been lightweighted, in which contact with adjacent bottles can cause denting or the bottle to fall over.

Generally, ribs 270 are positioned on body section 100. For example, ribs 270 can be positioned on side heel segments 222 and can form at least part of lower label bumper 120.

In one embodiment, rib 270 is formed at a rib location by forming an inward indentation 260 below the rib location.

Additional or alternate ribs 470 can be formed by the inward indentations 464 on end dome portions 460. Ribs 470 can form part of upper label bumper 110.

A method of making a blow-molded plastic container is also provided. A parison is disposed in a mold cavity having a surface and a container body region having a substantially non-circular shape in cross section. The container body region includes an enclosed base region and is at least partially defined by substantially flat side portions extending upwardly from the base region. A finish region of the mold cavity defines an opening, and a dome region of the mold cavity extends from the body section region to the finish region. The parison is distended against the mold surface to form the plastic container.

The mold cavity can be configured to produce any number of features in the finished containers. For example, the mold cavity can be adapted to produce at least one stiffening groove in the dome, an outwardly indented substantially horizontal rib and inwardly indented panel below the horizontal rib, and/or stiffening grooves in a heel section.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A blow-molded plastic container, comprising:

a body section having (a) a substantially non-circular shape in cross section, (b) a lower label bumper, (c) an enclosed bottom portion that forms a bottom end of the container, (d) a heel portion that includes side heel segments joined together at corners and transitions from the bottom portion to substantially flat side portions extending upwardly from the bottom portion, and (e) at least one stiffening groove located at one of the corners of the heel portion and extending substantially from the lower label bumper to a lower surface of the bottom end;

a dome extending from the body section; and a finish extending from the dome and defining an opening.

2. The plastic container of claim 1, wherein the at least one stiffening groove is adapted to increase top loading.

3. The plastic container of claim 1, wherein the at least one stiffening groove is inwardly indented.

4. The plastic container of claim 1, wherein the at least one stiffening groove is outwardly concave.

5. The plastic container of claim 1, wherein the body section includes at least one vacuum panel on at east one of the substantially flat side portions.

6. The plastic container of claim 1, wherein the body section includes four substantially flat side portions and the heel portion includes four heel segments joined together to form four corners, wherein the heel portion includes a plurality of the stiffening grooves, with one stiffening groove being located at each of the four corners.

7. The plastic container of claim 1, wherein the dome includes a plurality of dome faces defining corners in plan view, each dome face including a concave region in side view proximate to the body section and a convex region in side view between the concave region and the finish.

8. The plastic container of claim 1, wherein the lower surface of the bottom end has a push up base, the at least one stiffening groove extending substantially from the lower label bumper to the push up base.

9. The plastic container of claim 1, wherein the bottom end includes a push-up base.

10. The plastic container of claim 1, wherein the heel portion includes at least one rib.

11. The plastic container of claim 10, wherein the at least one rib is adapted to increase bumper resistance.

12. The plastic container of claim 10, wherein the at least one rib is inwardly indented.

13. The plastic container of claim 12, wherein the at least one rib includes ribs on opposing side heel segments of the heel portion.

14. The plastic container of claim 1, wherein the body section includes at least one rib on at least one of the substantially flat side portions.

15. A blow-molded plastic container comprising:

a body section having (a) a substantially non-circular shape in cross section, (b) an enclosed bottom portion that forms a bottom end of the container, (c) a heel portion that transitions from the bottom portion to substantially flat side portions extending upwardly from the bottom portion and includes at least one stiffening groove, and (d) at least one vacuum panel on at least one of the substantially flat side portions;

a dome extending from the body section; and a finish extending from the dome and defining an opening.

16. A blow-molded plastic container, comprising:

a body section having (a) a substantially non-circular shape in cross section, (b) an enclosed bottom portion that forms a bottom end of the container, (c) a heel portion that transitions from the bottom portion to substantially flat side portions extending upwardly from the bottom portion and includes at least one stiffening groove;

a finish defining an opening; and a dome extending from the body section to the finish and including a plurality of dome faces defining corners in plan view, each dome face including a concave region in side view proximate to the body section and a convex region in side view between the concave region and the finish.

17. The plastic container of claim 16, wherein the dome further includes at least one stiffening structure.

18. The plastic container of claim 17, wherein the stiffening structure is adapted to increase top loading strength of the container.

19. The plastic container of claim 18, wherein the at least one stiffening structure is formed by an inwardly-indented, vertically-extending groove at each corner of the dome.

20. The plastic container of claim 19, wherein each inwardly-indented, vertically-extending groove is concave in cross section.

* * * * *